United States Patent [19]

Simon

[11] Patent Number: 4,764,124

[45] Date of Patent: Aug. 16, 1988

[54] SELF STRIPPING CONNECTION DEVICE

[76] Inventor: Guy Simon, La Grosse Roche, F-44680 Sainte Pazanne, France

[21] Appl. No.: 40,063

[22] Filed: Apr. 20, 1987

[51] Int. Cl.[4] ..... H01R 4/24

[52] U.S. Cl. ..... 439/391; 439/394; 439/410

[58] Field of Search ..... 439/391, 393–396, 439/400, 401, 406, 409, 410, 417, 418, 434, 872

[56] References Cited

U.S. PATENT DOCUMENTS

| | | | |
|---|---|---|---|
| 2,908,884 | 10/1959 | Wirsching | 439/409 |
| 3,906,623 | 9/1975 | Clabburn et al. | 439/391 |
| 4,029,383 | 6/1977 | Harding et al. | 439/410 |
| 4,496,206 | 1/1985 | Markwardt et al. | 439/409 |
| 4,624,520 | 11/1986 | Blum | 439/394 |
| 4,637,675 | 1/1987 | Loose | 439/391 |

*Primary Examiner*—Gil Weidenfeld
*Assistant Examiner*—Paula A. Austin
*Attorney, Agent, or Firm*—Collard, Roe & Galgano

[57] ABSTRACT

A tubular, conductive housing has an axial opening defining an inner surface. An annular, outer lip projects from the inner surface. A centrally located axle within the housing has an annular inner lip opposing the outer lip. Cylinders at either end of the housing engage the axle in the housing and have apertures therein through which wires are inserted and located between the lips. Rotating the cylinders results in the wires being stripped and making electrical contact with the outer lip and conductive housing. Thereby, the wires become electrically interconnected to the conductive housing and to each other.

9 Claims, 3 Drawing Sheets

Fig 6
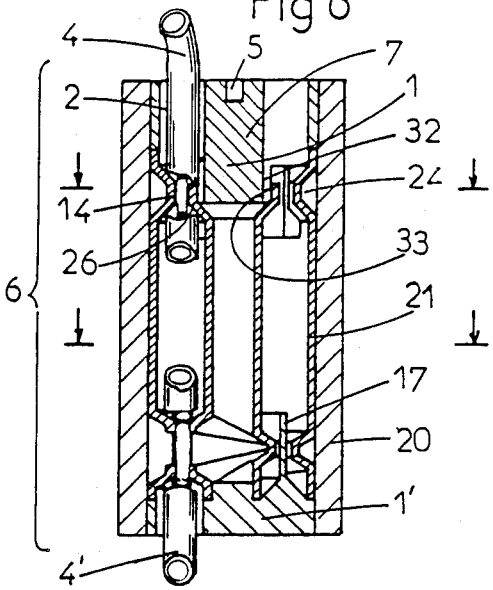
Fig 10
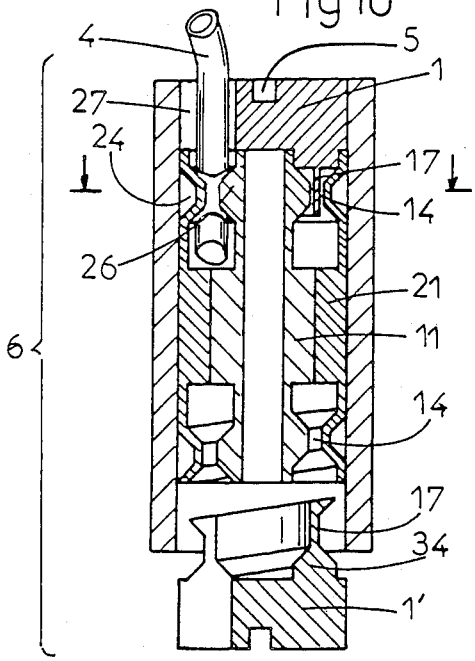
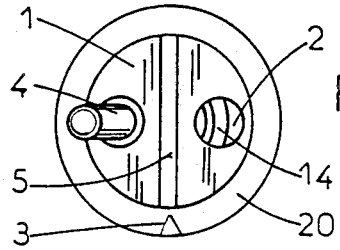
Fig 7
Fig 11
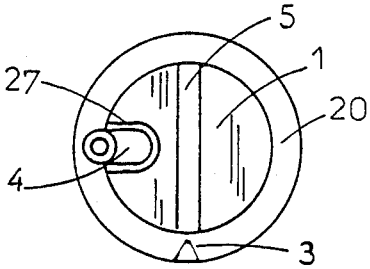
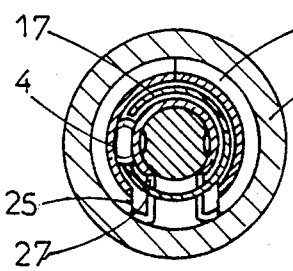
Fig 8
Fig 12
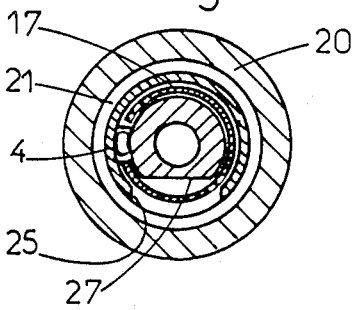
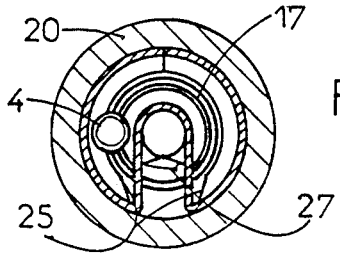
Fig 9

SELF STRIPPING CONNECTION DEVICE

BACKGROUND OF THE INVENTION

1. Field of the Invention

The present invention concerns a self-stripping connection device allowing for the rapid establishment of a contact between the conductors of insulated wires and an electrical terminal (intermediate connecting piece) without preparation of the insulated wires.

2. Description of the Prior Art

Generally, to establish an electrical connection between a terminal and a wire, several tools must be used, each of which allows the cutting, stripping and connection of the wire to the connector. In addition to the time and the skill necessary for such separate operations, the risks are great that there will be an intermittent failure or incomplete connection as a result of these separate processes. Indeed, when the core of the conductor is excessively cut by stripping or is excessively stressed by crimping, eventual rupture of the wires becomes a risk.

More recently, self-stripping contact devices have been utilized, which cut the insulating cover of the wires and strip the metallic conductor to establish a contact. Although this type of connection has the advantage of simplicity and speed, it requires the use of a specialized tool. Indeed, some tools require another special tool, in order to introduce the wires into the connecting device.

Moreover, contact devices are generally critical in regard to their support and their ability to withstand separation of the wires. The prior art devices, by damaging the wires, provide insufficient support and are also very sensitive to the phenomenon of corrosion.

Many diverse types of self-stripping connectors are known, for instance those which are described in European Pat. No. 0 002 113, West German Pat. No. 3 150 951, and French Pat. Nos. 2 251 927 and 2 561 825.

However, it seems clear that the principal difficulty with the prior art is the engagement of the wire into the engaging slot. In order to introduce a conductor into a slot of small size, it is necessary to apply a considerable symmetrical force on the wire on all sides of the wire as it is pushed into the slot. Otherwise, the connector will bend or break and it will not be possible to connect to it.

In the case of contact with circular slots, lateral force is also required because the wire is perpendicularly inserted and it is difficult to grasp the wire.

In European Pat. No. 0 002 113, the transmission of the movement to create the connection is made through the device, but that technique, if it is to work, employs a complicated and large mechanism and is thus costly.

In W. German No. 3 150 951 and French No. 2 251 927, the problem is resolved by using a tool which forms the two lips of the engaging, circular slot from two moveable pieces which rotate in opposition to each other. The connecting wire is introduced into the two opposing pieces and by rotation of one or the other, the connection is established. This technique has a number of drawbacks. In addition to it having two moveable parts that are not utilized in the contact, the stripping of the wire is only effected on the lip of the moveable slot, wherever the wire happens to be. The stripping of the wire is not accomplished in a symmetrical fashion at the core of the conductor, and thus there is a considerable risk that the insulation will "creep" over the connection, making good electrical contact impossible.

In FR No. 2 561 825, the self-stripping contact is without a slot, which simply permits the contact to take the shape of the barrel in order to be able to carry along the wire on either side of the point of contact. The corrective technique of providing a slot, though appearing obvious, has a major weakness because the pressure on the contact is caused by the plastic skirt of the barrel. One might think that the pressure of the contact exercised by this skirt is sufficient. It is however not likely that the insulation of the wire, which serves as an intermediary, could provide support under prolonged pressure without "creeping".

Besides the drawbacks noted above, the size and weight of these connectors are of the order of 10 times the diameter of the wire that needs to be connected. These dimensions prohibit the use of such contacts in average applications particularly when the required size of connectors is further decreasing.

SUMMARY OF THE INVENTION

An apparatus for use with a wire having a conductor and an insulating cover over the conductor. The apparatus electrically connects to the conductor by stripping away a part of the insulating cover and directly contacting the conductor.

A housing having an axial opening therein defines an inner surface. First means strips the insulating cover and connects to the conductor. The first means is attached to the inner surface of the housing. Second means strips the insulating cover and connects to the conductor. The second means is centrally located in the axial opening of the housing and opposes the first means.

Third means supports the wire between the first means and the second means and moves the wire with respect to the first means. The first means cooperates with the second means to strip the insulating cover as the wire is moved by the third means thereby establishing an electrical contact between the conductor and the first means.

It is an object of the invention to provide:

ease of utilization, by reducing the number of tools and, if need be, reducing manual operations.

rapid connection by eliminating the preparation of the wire and by reducing the time of connection.

high performance by completely wrapping the terminal to guarantee excellent insulation and a resistance against corrosion.

safety from electrical shock because no metallic part is exposed and because the nonconductive material is chosen for its great strength.

reduced size because the clipping point of connection can, in certain cases, be three times the diameter of the wire to be connected; this essential quality allows the invention to be used in a number of applications where small connectors are required.

diversity of functions by permitting the same terminal to make two opposed contacts, to introduce one or several wires in the same slot and to retract one or more wires very easily.

low cost resulting from the small dimensions; the invention can be made with lesser cost compared to existing devices.

The objects enumerated are thus met in an elegant fashion by employing a combination contact (slot)/barrel other than those which are known.

Indeed, since it is difficult to cross or to shape the contacts in order to connect the wire, the invention employs a cylindrical partition set on top of the terminal. The wire passes through an aperture in the cylinder. Rotating the cylinder shifts the wire into contact with lips of the terminal while supporting the wire on either side of the lips.

BRIEF DESCRIPTION OF THE DRAWING

The invention may be employed in various embodiments, several of which are illustrated hereafter in reference to the drawing and are not limited to the given examples. In the drawing:

FIG. 6 is a cut away view of another embodiment of the connection device according to the invention.

FIG. 7 is a top plan view of FIG. 6.

FIGS. 8 and 9 are sectional views of FIG. 7 taken along lines 1—1 and 11—11, respectively.

FIG. 10 is a longitudinal sectional view of another embodiment of a connection device according to the invention.

FIG. 11 is a top plan view of FIG. 10.

FIG. 12 is a sectional view taken along lines 111—111 of FIG. 10.

DETAILED DESCRIPTION OF THE INVENTION

Figure 1:
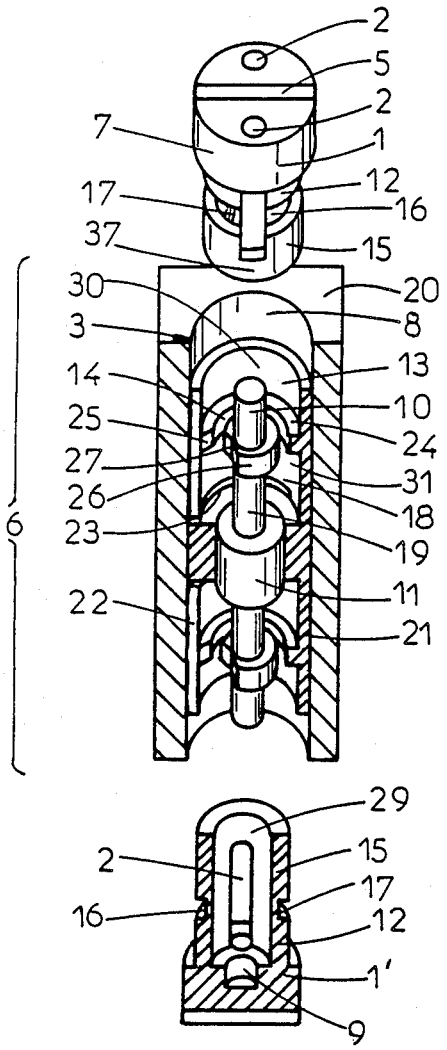
FIG. 1 is a partial longitudinal, cross-sectional view of one embodiment of a connection device according to the invention with the upper cylinder shown in perspective.
Figure 2:
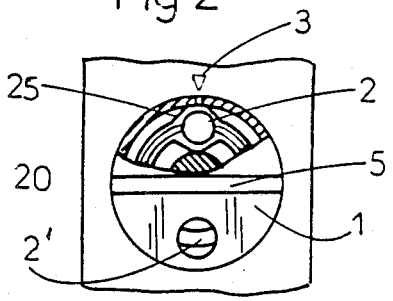
FIGS. 2 to 5 are top plan views, partially in section, of the same device as shown in FIG. 1, illustrating the different phases of operation of the connection device.
Figure 3:
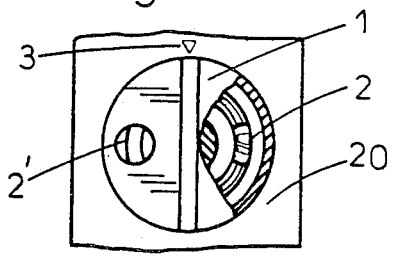
Figure 4:
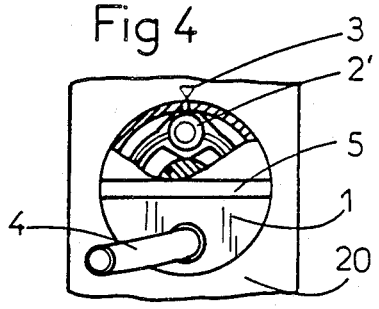

In order to better understand the operation of the connection device, FIGS. 2, 3, 4 and 5 are top plan views in partial cross-section of the device of FIG. 1. For the operator who has to use these connection devices, the case is presented in the form of a parallelpiped slide in which the barrels are placed. These barrels are arranged top to bottom on the two faces of the slide and resemble flat head screws having apertures. On the edge of each case, a triangular engraved index indicates a preferred position.

The connecting operation is simple:

With the aid of a screwdriver placeable in groove 5, cylinder 1 is rotated to align aperture 2 in front of the triangular index 3.

A wire 4 is then introduced into aperture 2 up to a stop. The operator then rotates the cylinder 1 (FIG. 2) by at least 45 degrees (90 degrees on FIG. 3) in order to connect the wire.

Figure 5:
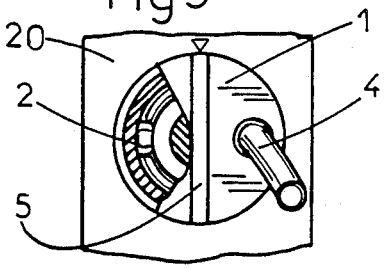

If, after initial use (FIG. 4), the operator wants to connect a second wire without disconnecting the first wire, the operator will rotate cylinder 1 in order to bring the second aperture 2' in registry with index 3. The operator will then introduce the second wire and rotate cylinder 1 at least 45 degrees, so that both wires are simultaneously connected (FIG. 5). From the preceding position (FIG. 5), the operator can retrieve one or the other of the connected wires by rotating cylinder 1 to the triangular index 3. It will be noted that due to its symmetry, the connector according to the invention can carry out both connection and disconnection with equal ease. The rotation of the cylinder 1 is effected, for example, with the aid of a simple screwdriver, which engages slot 5 in the top of cylinder 1.

Referring to FIG. 1, it shows a connection device in longitudinal section in the embodiment having a terminal with two opposed contacts. The upper contact portion and the lower contact portion are identical and the description of the first contact applies to the second contact. The two connecting cylinders are shown outside of their housing for the sake of clarity. In reality, the two cylinders are permanently locked in the device. In other words, the device is equipped with a double terminal capable of receiving wires at each end, which explains the presence of the two opposed cylinders.

In considering this device from bottom to top, it will be seen that FIG. 1 shows the upper cylinder 1, the intermediate connecting housing 6, lower cylinder 1' and a shaft 10.

The cylinder 1 is a general cylindrical form made out of insulating plastic material. It is made up of four distinct parts. The head or top 7 of the operating portion is located in a chamber 8 of housing 6 and is formed with a slot 5 so as to be rotatable with the aid of a screwdriver. The holes 2,2' are predrilled allowing the wires 4 to pass therethrough. The outside diameter of the head or top 7 is adjusted so as to rotate (with a minimum of clearance) in chamber 8. On the inside of the head 7 of the cylinder 1, bore 9 is provided to cooperate with a shaft 10 coaxial with the intermediate connecting housing 6 (with a minimum of clearance) to rotate about the axle 11 during the process of connection.

A flange 12 of lesser depth is provided under the head 7 of the cylinder 1. This allows parts to be constructed with play between the shaft 10 of the axle 11 and the upper cylinder bore 30 so that cylinder 1 fits in the socket which is formed and rotates freely in the upper chamber 13 of housing 6. The portion of the flange 12 in alignment with the axis of hole 2 is split forming a groove which allows the wire to be moved into place at the connection point 14.

Between the upper flange 12 and a lower flange 15, there exists a split, keyed ring 16 with the split in alignment with hole 2. Ring 16 fulfills on essential function in the device. An annular groove 17 formed by the bottom of the keyed ring 16 and the inner cylinder bore 29 of cylinder 1 rotates freely in response to the positioning of the slot 5. Turning slot 5 imparts a highly efficient rotating force on groove 17 which permits an effective connection process as will be described below. Groove 17 also serves to fasten the lower flange 15 with the cylinder 1. Outer lip 24 engages and is located within groove 17.

The lower flange 15 rotates freely in the lower chamber 18 of the housing 6, i.e. between the neck 19 of the axle 11 and the lower cylinder bore 31. Flange 15 guides wire 4 during connection by reinforcing the groove 17.

The housing 6 has two identical opposing contacts, the upper contact and the lower contact. The housing 6 shown in FIG. 1 includes an outside insulating case 20 and socket 21. The socket 21 is a piece machined from metal with good conductive qualities such as, for example, brass. It is shown in the form of a cylinder, having a partial longitudinal split 22 and a partial transverse split 23. These splits 22 and 23 are designed to give a certain flexibility to the contact and to permit expansion as the cylinder 1 is located within lower flange 15. In this manner, the cylinder 1 closes socket 21. Advantageously, shaft 10 is set in socket 21 before closing socket 21 by inserting cylinder 1 into it, after which socket 20 is inserted into case 20.

The interior of the socket 21 is identically made at each end and each half comprises the upper cylinder bore 30, an outer lip 24, a lower cylinder bore 31 and an axial opening for shaft 10. The upper cylinder bore 30 and the lower cylinder bore 31 have the same diameter and allow the free rotation of the wire 4 and flanges 12, 15 of cylinder 1.

The lip 24 is an important part because it forms the outer lip of the connection slot 14. Lip 24 has a discontinuity formed by machining inclined surfaces 25 therein, arranged to let the wire 4 pass, and to allow the stripping of the conductent wire 4.

The shaft can be made of brass and the upper half of this symmetrical piece comprises, from top to bottom, an axle 11, an inner lip 26, a neck 19 and a shaft 10. The shaft 10 cooperates with the cylinder bore 9 made in the cylinder 1 and is retained by the inner lip 26 at the connection point 14.

When the outer lip 24 of the socket 21 and the inner lip 26 of the axle 11 are opposite each other, the play therebetween forms the connection point or slot 14 in registry with hole 2. The width of slot 14 is less than the diameter of conductor 4 and its depth is greater than the depth of wall 17 of ring 16 of cylinder 1. The outer lip 24 and the inner lip 26 of the axle 11 are machined to permit wire 4 to pass as the device is operated. Lips 24, 26 form inclined planes 25, 27 designed to strip and to prepare the conductor of the wire 4. The planes 25 and 27 form a "V" or a funnel shape at the entrance to connection slot 14. The neck 19 of the axle 11, situated under the ring 16 is a cut-off permitting the free rotation of the wire 4 and the lower flange 15 of the cylinder 1.

The diameter of the shaft 10 of the axle 11 is configured so that, when the device is assembled, axle 11 is driven by force into the hole of housing 6 and thereby held in place. As a result, axle 11 and housing 6 are stationary with respect to each other and do not rotate with respect to each other. The diameter of shaft 10 is made in conjunction with the diameters of the lips 24, 26 to allow easy mounting of axle 11 into socket 21.

The case 20 is a piece made from plastic material having any outer shape or form. A hole 8 is drilled through case 20 and case 20 is slotted to accept the central part of the socket 21 with a minimum play formed around the top 7 of cylinder 1.

On the case 20, adjacent hole 8, a triangular embossed index 3 indicates the position of cylinder 1 which permits hole 2 to be in registry with connection point 14 so the wire 4 to be inserted between inclined planes 25 and 27, i.e. index 3 is situated opposite to the cut "V" entrance at the connection point 14.

The diameter of the cylinder 1, and, consequently of the whole device, is chosen as a function of the diameter of the connecting wires 4 and of the type of connection to be made. For example, it can be made between 3.6 and 5.5 mm.

Another embodiment of the device according to the invention is shown in FIGS. 6, 7, 8 and 9. The principal by which this embodiment forms an electrical connection is identical with the embodiment of FIGS. 1–5 except that in the lower contact the cylinder 1′ is fixed with respect to case 20. This embodiment is characterized by another type of terminal connection formed by rotation of the contact and a different type of connection lips.

The connection of wires 4 and 4′ is simultaneously effected by turning the structure forming the inner lips or shoulders 26 with the help of the upper cylinder 1. As the cylinder 1 and shoulders 26 must be rotatably fastened to each other, it becomes necessary to introduce in place of a wire an interconnecting pin 32 permitting the driving of the contact around the wire. In FIGS. 1–5, the keyed ring 16 and groove 17 rotate across the connection point 14 and support wire 4 during the connection or disconnection operation.

In FIGS. 6–9, the upper cylinder 1 utilizes a pin 32 under the top 7 in the interior of the housing 6 of the device designed to penetrate (with some play) into a cut-off 33 to engage shoulders 26 which form the central axle. This is designed to support and rotate the axle during the process of connection.

The device is always comprised of a socket 21 and an axle centrally formed by two metalic shoulders (or lips) 26. In other words, if one separates these two parts, one obtains a single flange of little depth cut into adequate form.

The lips 24 of the connection point 14 as well as the "V" entrance necessary for the stripping and preparation of wire 4 are formed by the outer wall of socket 21 and by shoulders 26 rather than on the axle and inner wall by stamping.

In the lower contact of FIG. 6, a variant of the lip construction is illustrated. It permits the lips to strip the connected wire 4 more accurately and remove longer portions of insulation. The stampings of the lips on the two parts of the device are not strictly perpendicular and parallel to the axle but are helically formed to be somewhat oblique and divergent. From the "V" entrance, the two lips of the slot get wider and separate as cylinder 1′ is rotated to enlarge the stripped zone of the wire.

The connection device described in FIGS. 10, 11 and 12 differs from previous devices in several aspects which result, in part, from the fact that the socket 21 is not split. This model is different in that its upper cylinder 1 does not interlock with socket 21 or the wire 4 and by the fact that its lower barrel 1′ is screwed onto socket 21 and threadably engages it. The upper cylinder 1 does not have flanges for axial retention under the partition 17. Hole 2 for passage of the wire 4 is replaced by a notch or gap 27. This configuration permits the mounting and dismounting of the cylinder 1 of the device as often as necessary. For that reason, cylinder 1 could, if desired, constitute an assembly tool, to which one could attach a handle.

The lower barrel 1′ is mounted on socket 21 by screwing and with this movement effects the connection of the wire. The unscrewing effects the disconnection. The lips 24, 26 of the socket 21 and those of the axle 11 are made in the form of a helicoidal thread and the connection point 14 is formed by a point where the heads of these threadings coincide. The cylinder 1′ has a form corresponding to these lips. Flange 34 projects into and is located between the lips 24, 26 and is threaded on its outside and on its inside it is either smooth or threaded. The partition permitting the connection of helicoidal form is obtained because the heads of the screw-cutting coincide with those of the threading.

Figure 13:
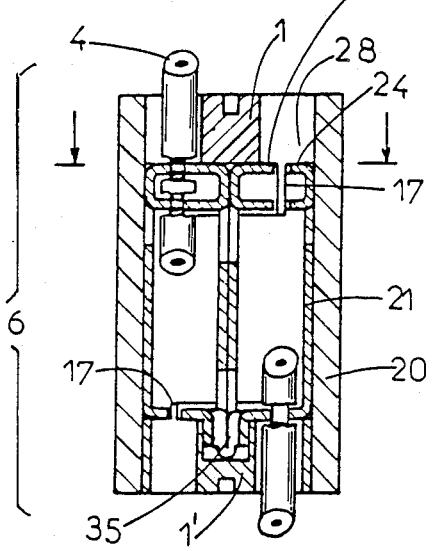
FIG. 13 is a longitudinal cross-sectional view of another embodiment of a connection device according to the invention.
Figure 14:
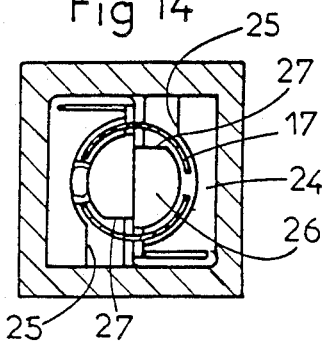
FIG. 14 is a sectional view of FIG. 13 taken along lines IV—IV.
Figure 15:
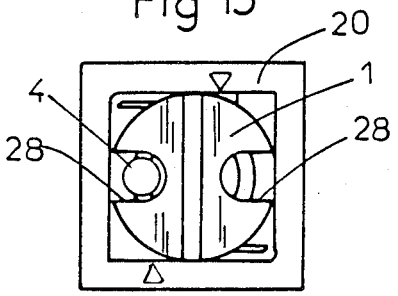
FIG. 15 is a top plan view of FIG. 13.

The connection device represented in FIGS. 13, 14 and 15 differs from previous ones in its parallelpiped form and its longitudinal symmetry of the housing 6. The housing 6 is constructed in two symmetrical longitudinal parts with regard to the axis of the axle 11 and is constructed in a rectangular form. The lips 24, 26 are formed by cutting and bending. The upper contact comprises a dual system of slots.

The upper contact of the terminal is in fact constituted of two half contacts housed in the same chamber 8 of the housing 6 and connected by a bridge 35 in the form of a small interior part.

In addition to the fact that these contacts are of rectangular or squared shape, lips 24, 26 defining the connection points 14 are formed by cutting and bending. In order to enlarge the surface of the contact between the housing 6 and the wire 4, the upper contact has two superimposed slot depths between the inner and outer lips 26, 24 which provide various widths. In terms of its function, this device can connect two wires simultaneously due to this system of dual entry points.

Figure 16:
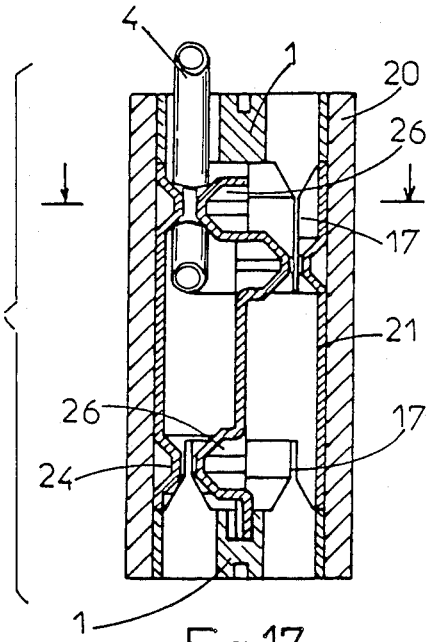
FIG. 16 is a longitudinal cross-sectional view of another embodiment of a connection device according to the invention, in its last phase of operation.
Figure 17:
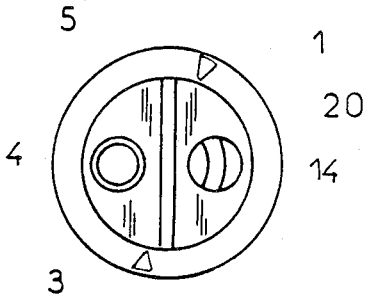
FIG. 17 is a top plan view of FIG. 16.
Figure 18:
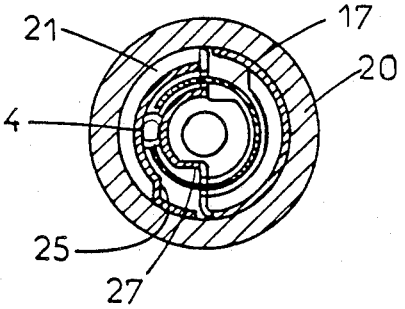
FIG. 18 is a sectional view of FIG. 16 taken along lines V—V.

The connection device of the FIGS. 16, 17 and 18 has an S-shaped structure and a system of slots offset on two levels. In the cut-out FIG. 18, the centrally located structure in an S-shaped form is shown with two half-loops of the S and one central, interconnecting part. The upper contact has a circular slot of 360 degrees, but is made on two levels of 180 degrees. Thus, a wire which would accomplish a complete circuit would be stripped and connected two times. The lower contact is a half contact which only functions through the rotation of 180 degrees. This embodiment is distinguished by an S-shaped structure of inner lip 26, by two vertically shifted levels, and by a single lower contact.

What is claimed is:

1. An apparatus for use with a wire having a conductor and an insulating cover over the conductor, said apparatus electrically connecting to the conductor by stripping away a part of the insulating cover and directly contacting the conductor, said apparatus comprising:

a housing having an axial opening therein defining an inner surface;

first means for stripping the insulating cover and for connecting to the conductor, said first means being attached to the inner surface of the housing;

second means for stripping the insulating cover and for connecting to the conductor, said second means being centrally located in the axial opening of the housing and opposing the first means;

third means for supporting the wire between the first means and the second means and for moving the wire with respect to the first means and the second means wherein said housing comprises a tubular member having a curved inner surface;

wherein said first means comprises an outer annular projection located on the curved inner surface of the tubular member;

wherein said second means comprises an axle having an inner annular projection, said axle being concentrically located within the tubular member such that the inner annular projection opposes the outer annular projection; and wherein said third means comprises a cylinder having an aperture for receiving the wire, said cylinder being concentrically located with the tubular member such that the aperture is in registry with the opening formed between the inner and outer annular projections, whereby the first means cooperates with the second means to strip the insulating cover as the wire is moved by the third means, thereby establishing an electrical contact between the conductor and the first means.

2. The apparatus of claim 1 wherein said outer annular, conductive projection comprises an outer lip located on and projecting from the curved inner surface of the tubular, conductive member, said outer lip having an inclined surface which forms a slot with the inner annular projection of the axle, whereby the wire may be inserted through the aperture in the cylinder into the slot.

3. The apparatus of claim 2 wherein said outer lip is helicoidally located on said inner surface.

4. The apparatus of claim 2 wherein said outer lip comprises upper and lower, oblique and divergent portions.

5. The apparatus of claim 2 further comprising a second outer lip opposing the inner lip of the axle, whereby the wire may be inserted between the first outer lip and the inner lip and between the second outer lip and the inner lip to provide a dual connection.

6. The apparatus of claim 2 wherein said cylinder has a second aperture in registry with the opening between said inner and outer lips and wherein the portion of the inner and outer lips in registry with the first aperture is concentrically above the portion of the inner and outer lips in registry with the second aperture.

7. The apparatus of claim 2 wherein said cylinder includes an annular groove having a split therein such that the groove engages the outer lip and the split is in registry with the aperture in the cylinder whereby inserting the wire in the aperture results in the wire being located in the split and between the inner and outer lips.

8. The apparatus of claim 7 wherein said cylinder includes left and right apertures, each for receiving a wire.

9. The apparatus of claim 7 further including a second cylinder located at the end of the tubular member opposite the first cylinder, said second cylinder having a second aperture for receiving the wire; further including a second outer lip located on the curved inner surface and a second inner lip located on the axle opposite the second outer lip, said second inner and outer lips forming a second opening in registry with the second aperture; and wherein each end of said axle is supported within said tubular member by engaging said first and second cylinders, respectively.

* * * * *